US005865658A

United States Patent [19]

Watkins

[11] Patent Number: 5,865,658

[45] Date of Patent: Feb. 2, 1999

[54] METHOD FOR EFFICIENT POSITIONING OF A GETTER

[75] Inventor: Charles Martin Watkins, Meridan, Id.

[73] Assignee: Micron Display Technology, Inc., Boise, Id.

[21] Appl. No.: 535,849

[22] Filed: Sep. 28, 1995

[51] Int. Cl.[6] ..... H01J 9/385

[52] U.S. Cl. ..... 445/25; 445/41

[58] Field of Search ..... 445/24, 25, 41; 313/495, 309, 336

[56] References Cited

U.S. PATENT DOCUMENTS

| | | | |
|---|---|---|---|
| 3,870,917 | 3/1975 | Cuny | 313/105 |
| 3,926,832 | 12/1975 | Barosi | 252/181.6 |
| 4,297,082 | 10/1981 | Wurtz et al. | 417/51 |
| 4,312,669 | 1/1982 | Boffito et al. | 75/177 |
| 4,743,797 | 5/1988 | Emberson et al. | 313/422 |
| 4,789,309 | 12/1988 | Giorgi | 417/51 |
| 4,839,085 | 6/1989 | Sandrock et al. | 252/181.6 |
| 4,874,339 | 10/1989 | Bratz | 445/28 |
| 4,940,300 | 7/1990 | Giorgi | 313/558 |
| 4,977,035 | 12/1990 | Travis et al. | 428/550 |
| 5,057,047 | 10/1991 | Greene et al. | 445/24 |
| 5,060,051 | 10/1991 | Usuda | 257/765 |
| 5,207,607 | 5/1993 | Nagano et al. | 445/25 |
| 5,223,766 | 6/1993 | Nakayama et al. | 313/309 |
| 5,283,500 | 2/1994 | Kochanski | 313/309 X |
| 5,469,014 | 11/1995 | Itoh et al. | 313/309 X |
| 5,520,563 | 5/1996 | Wallace et al. | 445/24 |

FOREIGN PATENT DOCUMENTS 2-295032 12/1990 Japan .

2-295032 A 12/1990 Japan .

OTHER PUBLICATIONS

Borghi, M., Dr., *ST 121 and ST 122 Porous Coating Getters,* New Edition 19 Nov. 92, Original Jul. 87, pp. 3–13

Carella, S., Boffito, C., Carretti, C., "Gettering in Small Size Vacuum Microelectronic Devices".

Giorgi, T.A., *Proc. 6th Internl, Vacuum, Congr. 1974,* Japan J. Appl. Phys, Suppl. 2, Pt. 1974, "Getters and Gettering", pp. 53–60.

Giorgi, E. and Ferrario B., "High Porosity Thick Film Getters", pp. 1–10, Figs. 1–8, and References.

Giorgi E. and Ferrario, B., *IEEE Transactions on Electron Devices,* vol. 36, No. 11, Nov. 1989, High–Porosity Thick–Film Getters, pp. 2744–2747.

Giorgi, T.A., Ferrario, B., and Storey, B., *J. Vac. Sci. Technol,* A3 (2) Mar/Apr. 1985, "An updated review of getters and gettering ", pp. 417–423.

SAES GETTERS S.p.A., *ST 171 Non–Evaporable Porous Getters* .

SAES GETTERS S.p.A., *ST 175 Non–Evaporable Porous Getters*, pp. 1–5, Figs. 1–6.

*Primary Examiner*—Kenneth J. Ramsey

*Attorney, Agent, or Firm*—Hale and Dorr LLP

[57] ABSTRACT

A FED is provided comprising: an emitter located on a cathode; a pixel located on an anode positioned to receive electrons from the emitter; and a getter located on the anode. According to another aspect of the invention, a method of making an FED is provided comprising: depositing getter material over a tip on a cathode; assembling the cathode with an anode, wherein the getter is between the tip and the anode; and activating the getter, whereby the activation causes the getter to be deposited on the anode.

11 Claims, 6 Drawing Sheets

METHOD FOR EFFICIENT POSITIONING OF A GETTER

BACKGROUND OF THE INVENTION

This invention relates to flat panel displays and more specifically to positioning of getters in field emission devices ("FEDs"), examples of which are seen in U.S. Pat. Nos. 3,665,241; 3,755,704; 3,812,559; and 5,064,396, all of which are incorporated herein by reference.

In the use of FEDs, where there is a vacuum between and electron emitter and an anode, gas molecules are released which can cause operational problems (for example, see U.S. Pat. Nos. 5,223,766; and 4,743,797, incorporated herein by reference). Thus, a material commonly known as a "getter" is inserted in the vacuum space, for example on the side of the area between the emitter on the cathode and the phosphor on the anode. Common getter materials include titanium and other highly reactive materials. These materials react with the molecules generated during operation, preventing the molecules from causing voltage breakdown within the device.

However, the placement of the getter on the side increases the width of the display. Further, activation of the getter by heating or passing a current through the getter causes evaporation or sublimation of the getter material. Since the getter material is, at least in some cases, conductive, deposition of the material on the cathode or grid of the FED could cause shorts or otherwise adversely effect the operation of the device. Therefore, various bulky methods, such as shields, have been devised to isolate the getter from the cathode and grid. Therefore, during the evaporation or sublimation, the getter material will deposit on non-active elements in the vacuum space. Unfortunately, however, this results in the getter being placed in areas remote from the very location where molecules are generated—namely, the cathode, grid and anode.

Therefore, there is a need for a method and device for placement of a getter in an FED wherein the activation of the getter does not cause a deposit of conductive material on the grid or cathode, wherein the getter is near the locations where molecules are generated, and without the extra space and bulk used in previous devices and methods.

It is an object of the present invention to fulfill those needs.

SUMMARY OF THE INVENTION

According to one aspect of the invention, a FED is provided comprising: an emitter located on a cathode; a pixel located on an anode positioned to receive electrons from the emitter; and a getter located on the anode.

According to another aspect of the invention, a method of making an FED is provided comprising: depositing getter material over a tip on a cathode; assembling the cathode with an anode, wherein the getter is between the tip and the anode; and activating the getter, whereby the activation causes the getter to be deposited on the anode.

DESCRIPTION OF THE DRAWINGS

For a more complete understanding of the present invention and for further advantages thereof, reference is made to the following Detailed Description taken in conjunction with the accompanying drawings, in which.

It is to be noted, however, that the appended drawings illustrate only typical embodiments of this invention and are therefore not to be considered limiting of its scope, for the invention may admit to other equally effective embodiments.

DETAILED DESCRIPTION

Figure 1:
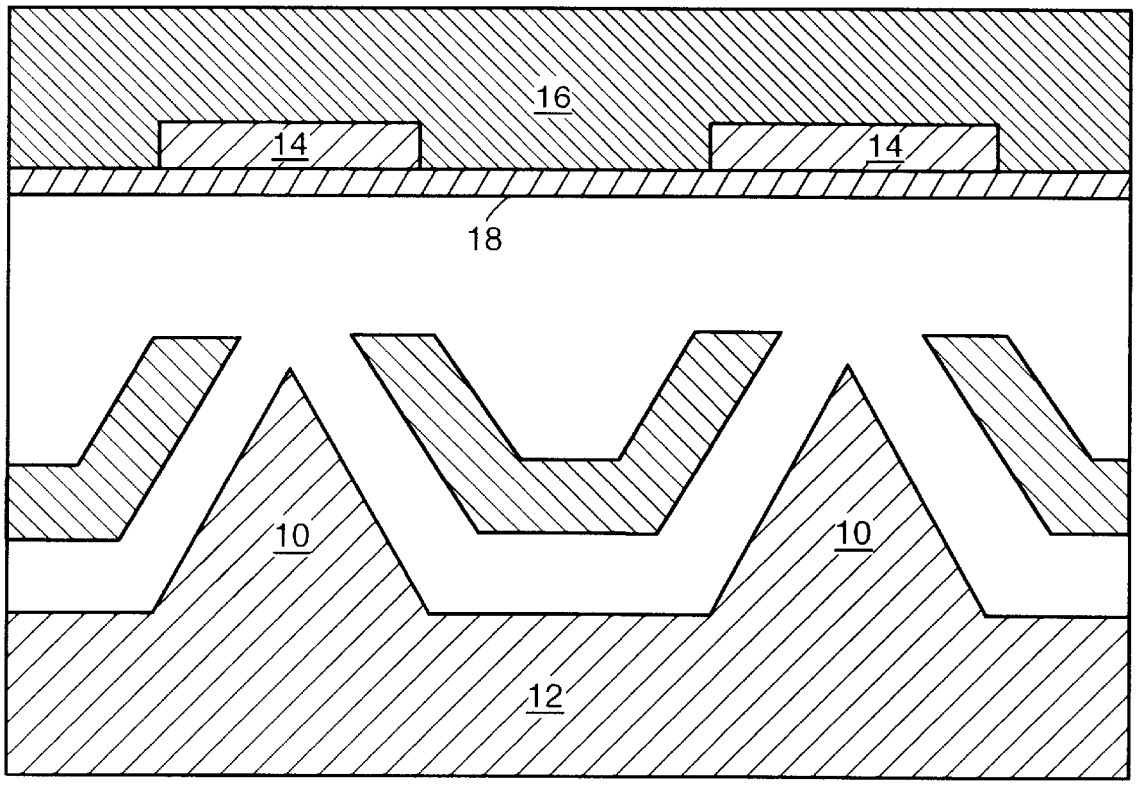
FIGS. 1 and 2 are cross-sectional views of an FED according to an embodiment of the present invention.

Referring now to FIG. 1, an example FED of the invention is shown. As those of skill in the art will recognize, what is seen is a representational view of a portion of a pixel of an FED, each pixel having multiple emitters, although one pixel per emitter is also within the scope of the invention. Two such emitters (10) are seen in FIG. 1, formed integrally on a cathode (12); a phosphor (14) on an anode (16). The phosphor (14) is positioned with respect to the anode (16) to receive electrons from the emitter (10). Between the phosphor (14) and the emitter (10) is the getter (18). According to this example, the getter (18) comprises a few monolayers of getter material, thin enough to allow electrons from emitter (10) to cause phosphor (14) to emit light through the anode (14).

It will be understood that FIG. 1 is representational only, is not to scale, and does not disclose other layers of cathode (12) or anode (16) that are used in various embodiments of the device but are not the focus of the present invention. Those of skill in the art will, nevertheless, understand the manufacture of various devices using the present invention.

Figure 2:
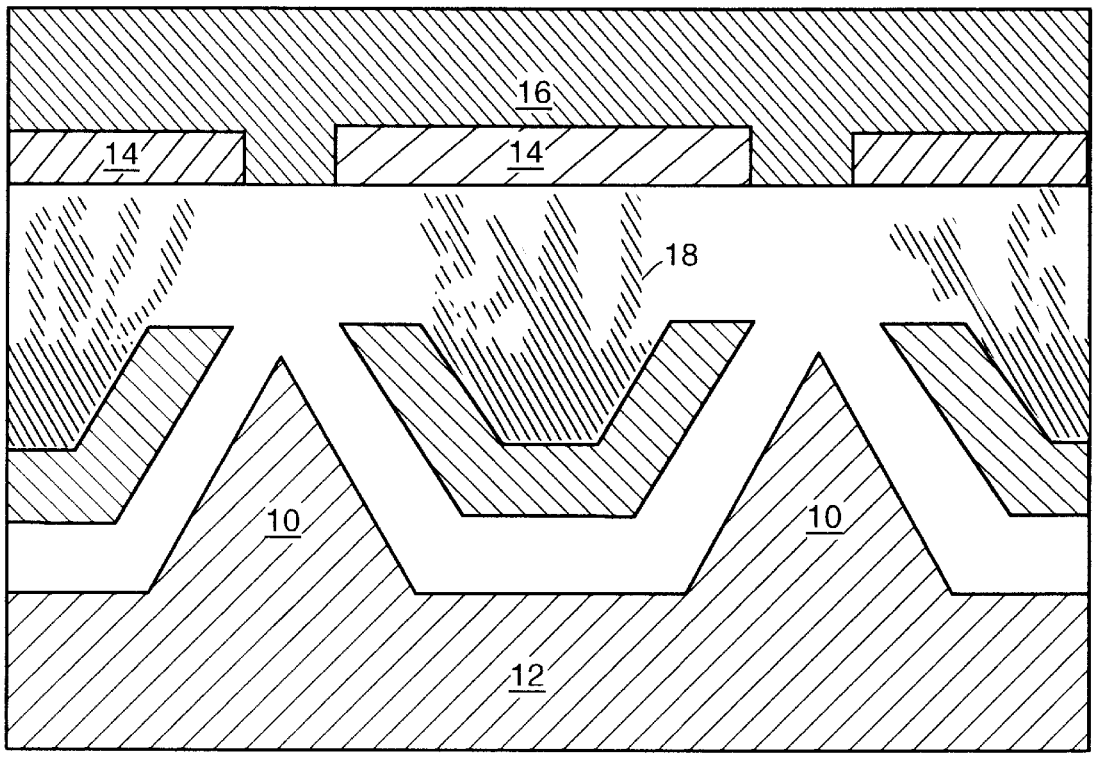

Referring now to FIG. 2, in making an FED according to the present invention, an acceptable method comprises depositing getter material (18) over a cathode (12); assembling the cathode (12) with an anode (16). After assembly, the getter (18) is activated, causing the getter (18) to be deposited on the anode (16).

Figure 3:
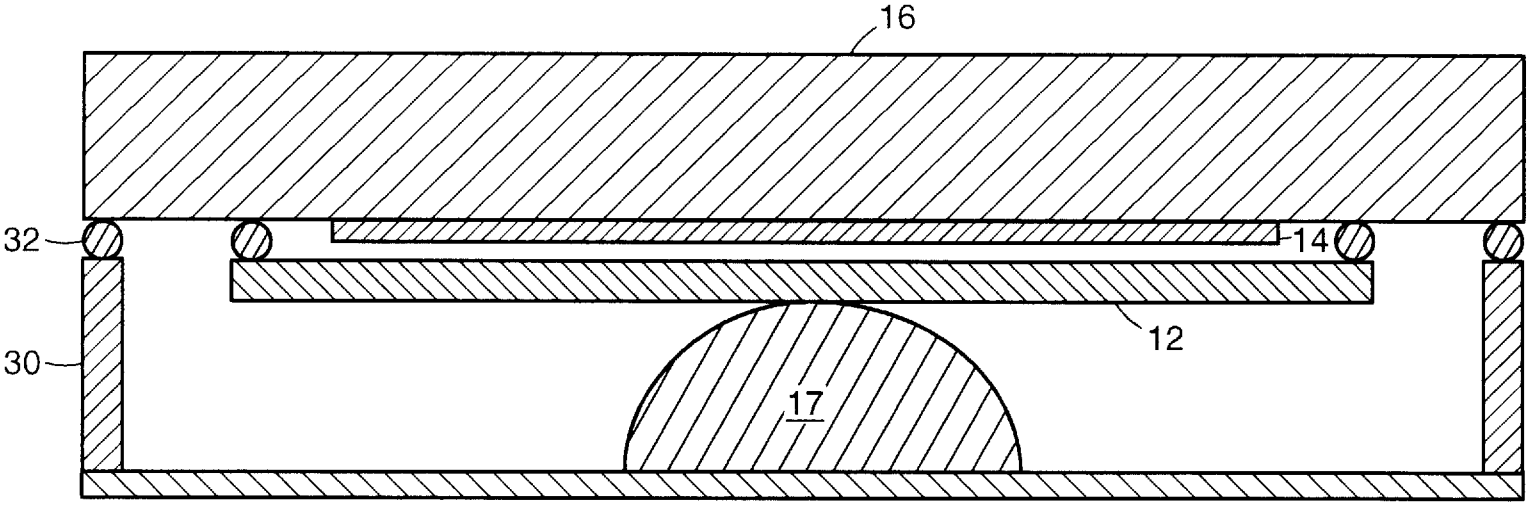
FIG. 3 is a cross-sectional view of a sealed anode and cathode.

According to one acceptable process, the activating comprises heating the assembled cathode and anode. According to one method, as seen in FIG. 3, the anode and cathode are sealed in glass (30), which is sealed by heating a glass frit (32). The getter material (18) is chosen to activate at a temperature at or below the temperature at which the frit seals. Acceptable frits are matched with the glass from a thermal expansion aspect. Also seen in FIG. 3 is support (17), which comprises frit of the same material as frit seal 32.

Acceptable getter materials include any of the known getter materials, for example: titanium, barium, zirconium, calcium, magnesium, strontium.

According to an alternative method, the sealing occurs after the activating.

Figure 4:
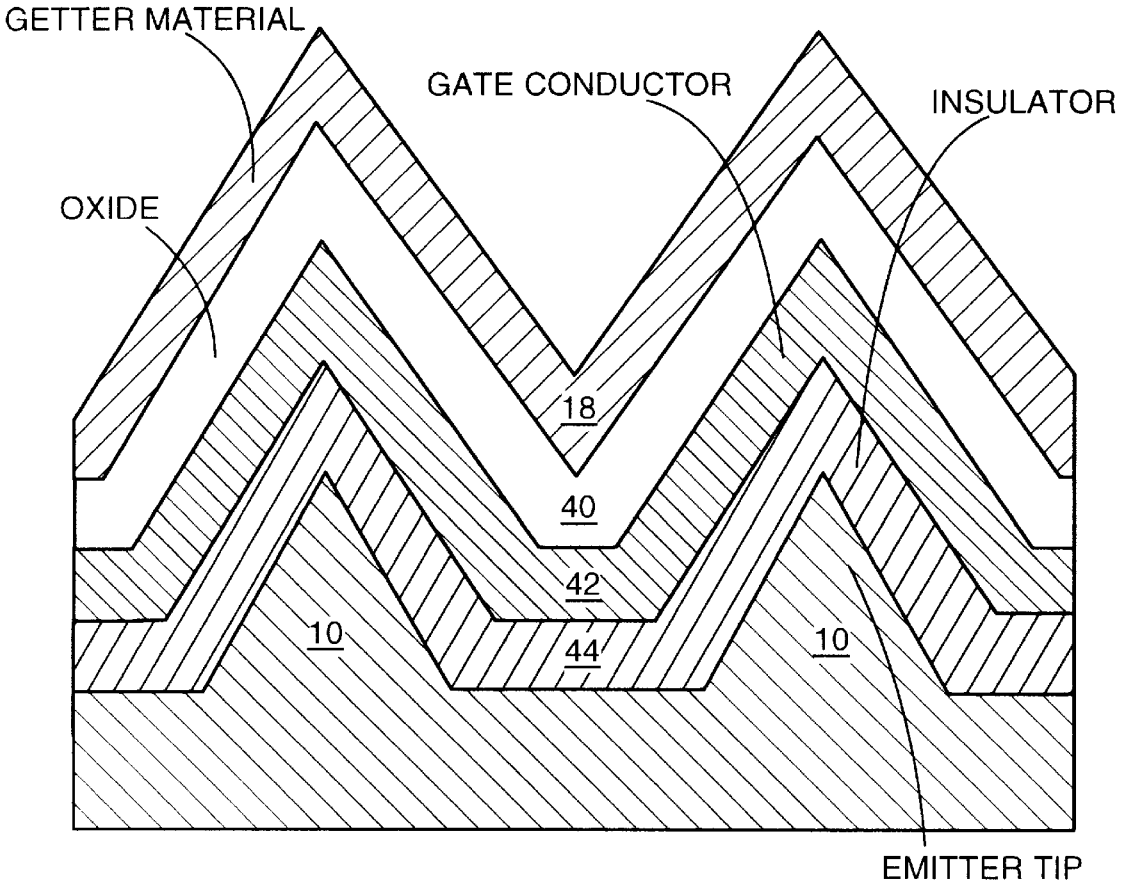
FIGS. 4 and 5 are cross-sectional views illustrating a first method for forming a getter on a cathode.

Referring now to FIG. 4, a method of deposition of the getter (18) is shown in which, in succession, an insulator (44) (for example, silicon dioxide) is formed over the emitter tip (10), a gate conductor (42) (for example, aluminum) is formed over the insulator (44), an oxide (40) is formed over the gate conductor (42), and a getter material layer (18) is formed over the oxide (40). Acceptable methods of forming of the layers will occur to those of skill in the art.

Figure 5:
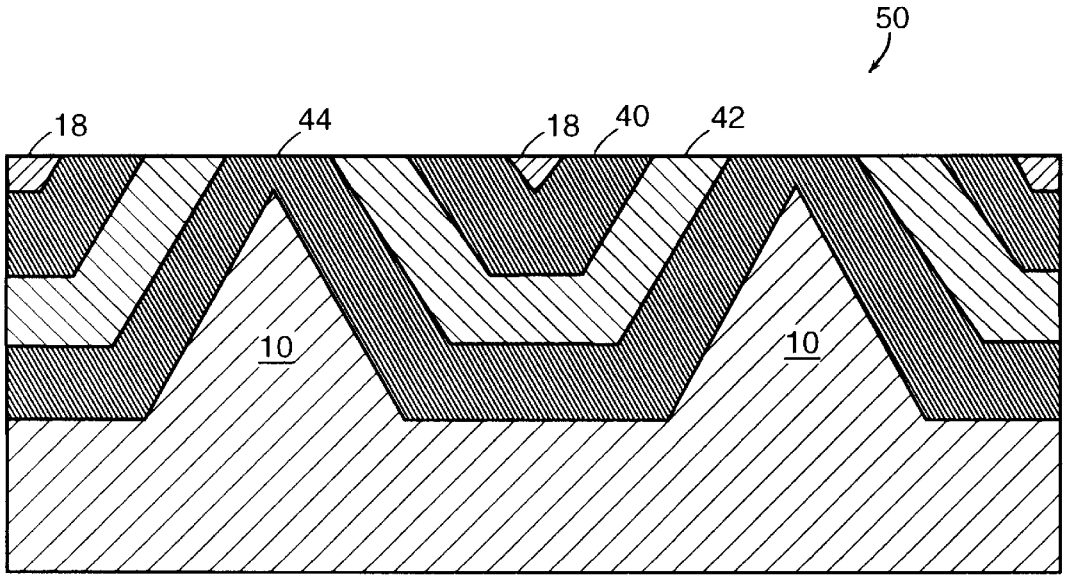

As seen in FIG. 5, chemical/mechanical planarization, a process understood by those skilled in the art, provides a getter material 18 in the oxide (40) over conductor (42).

After selective etching to expose emitter (10) from under insulator (44), the emitter assembly (50) is assembled as seen in FIG. 3, and getter material (18) is activated.

Figure 6:
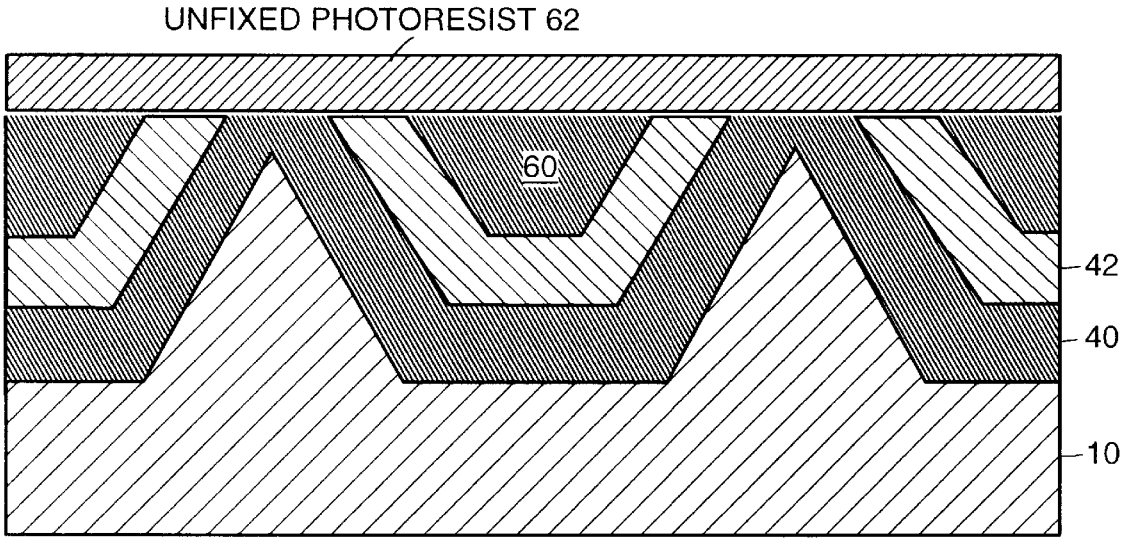
FIGS. 6 and 7 are cross-sectional views of a second method for forming a getter over a cathode. The getter make comprise a monolayer of getter material on the phosphor, or may a comprise a plurality of monolayers on the phosphor.
Figure 7:
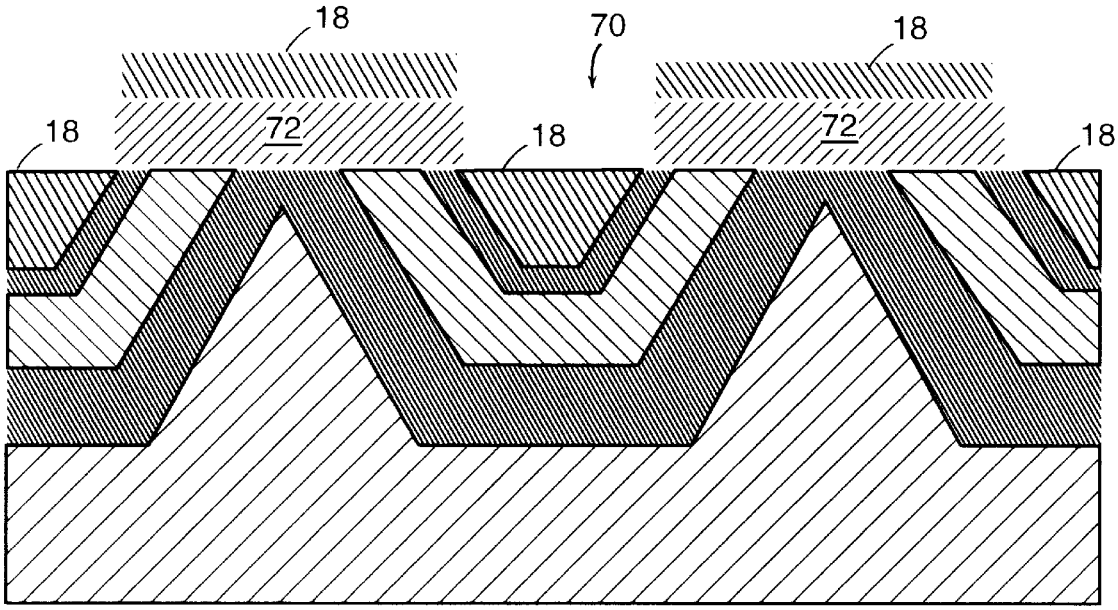

Referring now to FIG. 6, an alternative embodiment is seen, in which a thick layer of oxide (60) is deposited and then chemical/mechanical planarization is carried out. Next, unfixed photoresist (62) is deposited, as shown. Then, as seen in FIG. 7, a portion of the photoresist over emitter (10) is fixed and the unfixed portion is removed to form fixed photoresist (72). Next, the oxide (40) is etched to form depression (70), into which getter material (18) is deposited by, for example, sputter, chemical vapor deposition, or other processes that will occur to those of skill in the art. The fixed photoresist is then removed along with any getter material that is on the fixed photoresist 72. Again, selective etch of the insulator (44) exposes the gate and emitter.

According to alternative embodiments, the getter material is deposited directly on the gate material, without any oxide between.

What is claimed is:

1. A method for making an FED comprising:

providing a getter material over a cathode that has a plurality of emitters;

assembling together the cathode with an anode including sealing the cathode and the anode with a frit glass seal, the sealing including heating the cathode and anode so that the getter material deposits on the anode and is activated.

2. A method as in claim 1 wherein said getter material comprises a sublimating material.

3. A method as in claim 2 wherein said activating step comprises heating the assembled cathode and anode to the sublimation temperature of the getter material.

4. A method as in claim 3, wherein the sealing is not complete until after the activating.

5. A method as in claim 3 wherein said getter material comprises titanium.

6. A method for making an FED comprising:

providing a getter material over a cathode that has a plurality of emitters;

assembling together the cathode with an anode; and activating the getter material so that the getter material deposits on the anode;

wherein the providing includes forming over the cathode a mask that covers the emitters, depositing a getter material over the cathode so that the getter material is between at least some adjacent emitter tips, and removing the mask from over the emitters.

7. A method for making a display device comprising:

forming a number of generally conical emitters;

forming an insulating layer over the emitters and over regions between the emitters;

forming a conductive layer over the insulating layer;

forming a dielectric layer over the conductive layer;

forming a layer of getter material over the dielectric layer; and planarizing the structure to remove at least some of the layer of getter material, the dielectric layer, the conductive layer, and the insulating layer so that regions of getter material are surrounded by regions of the dielectric and the conductive layer and disposed between adjacent emitters.

8. The method of claim 7, further comprising the step of heating the cathode structure to activate the getter material.

9. The method of claim 7, further comprising a step of assembling together the cathode with an anode so that the cathode and anode are hermetically sealed together.

10. A method for making a display device comprising:

forming a number of generally conical emitters;

forming an insulating layer over the emitters and over regions between the emitters;

forming a conductive layer over the insulating layer;

forming a dielectric layer over the conductive layer;

forming a layer of getter material over the dielectric layer; and planarizing the structure to remove at least some of the layer of getter material, the dielectric layer, the conductive layer, and the insulating layer so that regions of getter material are surrounded by regions of the dielectric and the conductive layer and disposed between adjacent emitters;

assembling together the cathode with an anode so that the cathode and anode are hermetically sealed together, wherein the assembling step also activates the getter material.

11. A method for making a display device comprising:

forming a number of generally conical emitters;

forming an insulating layer over the emitters and over regions between the emitters;

forming a conductive layer over the insulating layer;

forming a dielectric layer over the conductive layer;

forming a layer of getter material over the dielectric layer; and planarizing the structure to remove at least some of the layer of getter material, the dielectric layer, the conductive layer, and the insulating layer so that regions of getter material are surrounded by regions of the dielectric and the conductive layer and disposed between adjacent emitters.

* * * * *